US005731655A

United States Patent [19]

Corrado

[11] Patent Number: 5,731,655

[45] Date of Patent: Mar. 24, 1998

[54] SPARK PLUG WITH 360 DEGREE FIRING TIP

[76] Inventor: Paul A. Corrado, 5842 Tampa Ave., Tarzana, Calif. 91356

[21] Appl. No.: 614,212

[22] Filed: Mar. 12, 1996

[51] Int. Cl.[6] ..... H01T 13/20

[52] U.S. Cl. ..... 313/138; 313/141

[58] Field of Search ..... 313/125, 138, 313/139, 141, 142

[56] References Cited

U.S. PATENT DOCUMENTS

| | | | |
|---|---|---|---|
| 1,322,703 | 4/1919 | Lewis | 313/139 |
| 1,499,594 | 6/1924 | Riley | 313/138 |
| 2,073,865 | 3/1937 | Bushey | 313/139 |
| 2,900,546 | 8/1959 | Russell | 313/125 |
| 4,402,036 | 8/1983 | Hensley et al. | 313/138 |
| 4,695,758 | 9/1987 | Nishida et al. | 313/138 |

*Primary Examiner*—Sandra L. O'Shea
*Assistant Examiner*—Vip Patel
*Attorney, Agent, or Firm*—Robert J. Schaap

[57] ABSTRACT

A novel spark plug with an outer annular electrode and an inner electrode includes a disk-shaped element supported atop the inner electrode. The gap between the outer electrode and the disk-shaped element of the inner electrode defines an annular firing zone within which the spark travels from the outer electrode to the inner electrode. The disk-shaped inner electrode is solid and planar, and overlies the outer electrode. The disk may be provided with a lip of hardened alloy material which extends in the direction of the outer electrode. The lip can have a rectangular cross-section or a triangular cross-section, and the gap between the inner and outer electrodes can be adjusted, either at the time of assembly or later.

22 Claims, 1 Drawing Sheet

FIG. 1
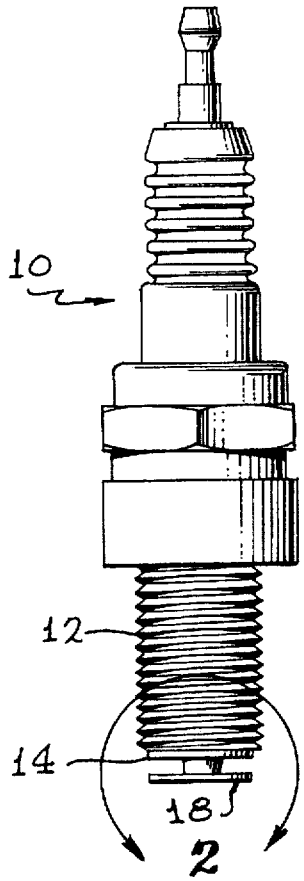
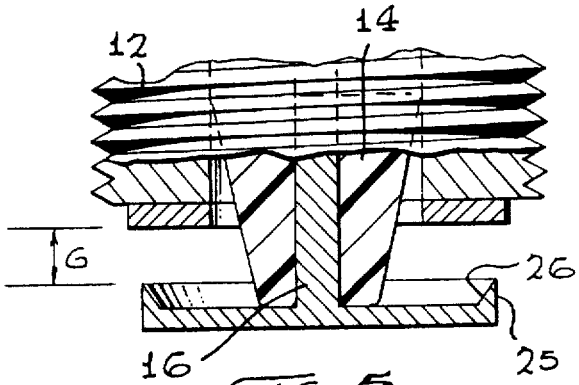
FIG. 5
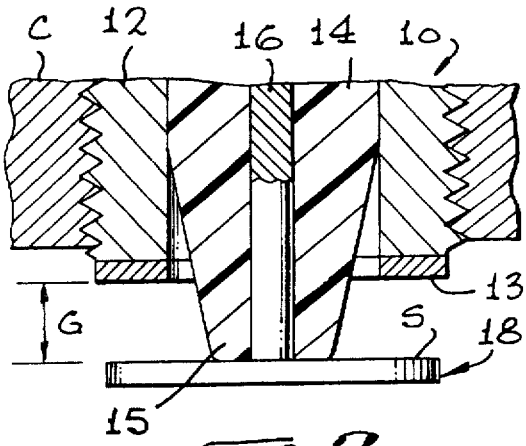
FIG. 2
FIG. 3
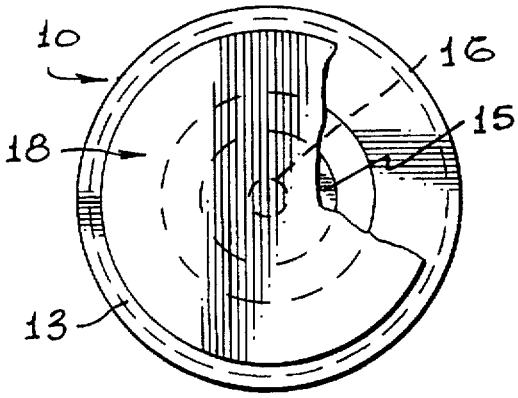
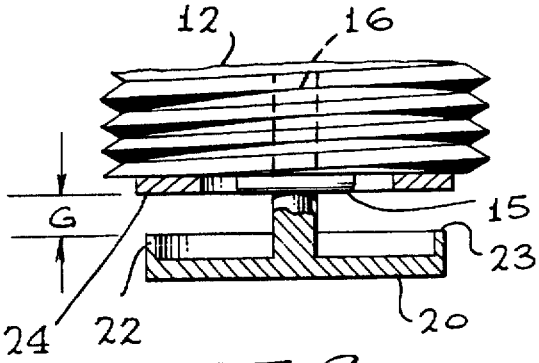
FIG. 4

SPARK PLUG WITH 360 DEGREE FIRING TIP

BACKGROUND OF THE INVENTION

1. Field of the Invention

The present invention relates to spark plugs for internal combustion engines, and more particularly to a novel spark plug with a 360° firing tip configuration which reduces fouling and enables cleaner, more economical and more efficient burning of the combustible gases in the cylinders of internal combustion engines.

2. Description of the Related Art

Spark plugs of conventional design, and employed almost universally in small engines and automotive type engines, are distinguished essentially by two features.

First, all such plugs possess an outer electrode and an inner central electrode, and produce a single spark confined within a small finite area located in the vicinity of the center electrode.

Second, in such plugs, the spark typically begins at the outer grounded electrode and travels toward the inner, center positive electrode.

In regard to the first of such features, the space between the electrodes within which sparking is conducted is typically significantly limited in dimension to insure greatest intensity as well as accuracy of location of the spark. This aspect of plug design affects the accumulations of carbon deposits and oil that are typically left on the insulator and electrodes during plug operation and which tend to diminish the sparking effectiveness and overall efficiency of the plug. It is now well known that the common spark plug, having a single central spark gap, is subjected to a range of working temperatures, including extremely high temperatures, which tend to overheat the ground electrode, to cause electrical resistance to greatly increase and to rapidly diminish the plug's serviceability, thereby requiring frequent replacements. Such conventional spark plugs are based upon the principle of thermal cleansing and for this reason are designed to function at predetermined high working temperatures; otherwise, the spark gap erodes and becomes fouled with carbon and oily sludge. However, the high working temperatures can cause undesirable detonation and pre-ignition.

In regard to the second of such features, conventional spark plug designs have evolved based on low voltage point type ignitions and the knowledge that gas vapors introduced into the cylinder are densest at or near the central ground electrode because they have not flowed far enough away from their introduction point to the cylinder adjacent the plug. This theory, however, has been virtually discarded since it is now recognized that the gas vapors are densest at the dome of the cylinder head, as the latter approaches the top of its stroke and compression of the vapors takes place.

OBJECTS AND SUMMARY OF THE INVENTION

It is therefore an object of the present invention to provide a spark plug which provides rapid and even fuel ignition, and extremely efficient sparking conditions, which are greatly enhanced by today's advanced electronic ignition high-voltage systems and will overcome all the deficiencies and drawbacks of spark plugs currently known.

Another object of the present invention is to provide a spark plug having a center positive electrode structure which is novel in design, Whereby accumulations of carbon and other undesirable deposits on the sparking and insulator surfaces are greatly reduced or entirely eliminated.

Still another object of the present invention is to provide a spark plug with a cylindrical outer ground electrode and an inner positive electrode supporting a disk-shaped element, where the element defines a continuous annular firing gap between the inner and outer electrodes, thereby establishing a more extensive combustion region.

Yet another object of the present invention is to provide a novel spark plug design having a cylindrical outer ground electrode and an inner positive electrode supporting a planar disk atop the inner electrode, wherein one or several sparks can be generated between the two electrodes and, in contrast to conventional spark plugs, the direction of travel of the spark is from the outer electrode to the inner electrode.

These and other objects are attained by the spark plug of the present invention which includes an outer cylindrical ground electrode and an inner positive electrode including a substantially flat disk-shaped element supported by the inner electrode above the outer electrode. The distance between the inner disk-shaped (the positive) electrode and the outer annular (the negative) electrode defines an annular firing zone between which the spark moves in a 360° direction so that the points of ignition change continually, thus causing flame propogation in random directions for elimination of cold spots in the combustion chamber, thereby preventing build-up of deposits.

Preferably, the inner electrode comprises a solid, planar disk overlying the outer electrode and defining between the two a gap "G". In a variation of the invention, the disk is provided with a lip which extends in the direction of the outer electrode. The lip can be alloyed and have a rectangular cross-section or a triangular cross-section, and the gap between the inner and outer electrode can be adjusted, either at the time of assembly or later.

BRIEF DESCRIPTION OF THE DRAWINGS

FIG. 1 depicts a spark plug in accordance with the present invention in side view;

FIG. 2 is an enlarged fragmentary view, partly in section, of the spark-generating end of the spark plug shown in FIG. 1;

FIG. 3 is an end view of the spark-generating end of the spark plug shown in FIG. 1;

FIG. 4 is a fragmentary side view, partly in section, of a spark plug with one variation of the disk-shaped electrode of the present invention; and FIG. 5 is a fragmentary side view, partly in section, of a spark plug with a second variation of the disk-shaped electrode of the invention.

DETAILED DESCRIPTION OF THE INVENTION

Referring now to FIGS. 1, 2 and 3, the spark plug 10 of the invention includes an outer ground electrode 12 (shown in FIG. 2 mounted within cylinder housing C) in which is disposed, in a manner known in the art, an insulator 14 which supports a central positive electrode 16. The insulator 14 has an end 15 which projects into the cylinder of the engine. The central electrode 16 includes a rod-shaped element which is frictionally mounted in and projects substantially axially from the end 15 of the insulator 14. The free end of the rod-shaped element is provided with a disk-shaped plate element 18 preferably attached at its center to the rod-shaped element as, for example, by welding. The disk-shaped element is of circular shape and has parallel opposing surfaces disposed in facing relationship with each other and to the contact face of the outer electrode 12.

Preferably, the contact face of the outer electrode 12 is provided with a hardened, annular, alloyed surface 13 to better withstand the constant abuse which results from the sparks that move from the contact face 13 to the disk-shaped element 18 of the inner electrode.

From FIG. 3, it can be seen that the disk-shaped element of the inner electrode is circular with a sparking surface (not shown in FIG. 3, but denoted as S in FIG. 2) arranged about the entire 360 degrees of the element, thus allowing the generated spark to jump the path of least resistance from the outer electrode to the inner electrode across gap G. The invention contemplates one or more sparks being generated at any time. The spark plug electrode shields the insulator 14 from the combustion of fuel, oil and/or air mixtures used in many internal combustion engines.

A spark plug fabricated in accordance with the present invention has been shown to have a life of well over 100,000 miles, and therefore eliminates costly tuneups and fuel consumption, keeps engine oil clean and improves engine performance. Use of such plugs will help to eliminate fouling in virtually all two cycle engines, including motorcycles, jet skis, chain saws, etc.

FIG. 4 shows a first variation 20 of the disk-shaped electrode in which an annular lip or flange 22 is located at the periphery of the electrode 20 and extends co-axially. The lip 22 has a rectangular cross-section and an annular face 23 which is disposed in opposition and parallel to the annular contact face 24 of the outer electrode 12. The distance between the contact face 24 and the annular face 23 defines a sparking gap G which can be varied by choosing an appropriate length of the end of the insulator 15 which projects beyond the contact face 24 into the cylinder (for example, by original equipment manufacturers) or by choosing an appropriate length of the rod-like element on which the disk-shaped element is supported (for example, by aftermarket suppliers).

FIG. 5 shows a second variation of the disk-shaped element of the spark plug in which the lip 25 of the element has a triangular cross-section and an annular oblique face 26 which is angled toward the center of the insulating element.

There has thus been described a novel spark plug tip structure which enables highly efficient burning of gas vapors so that deposits and products of combustion are kept from forming on the electrodes as well as the insulating element.

The anti-fouling 360° multiple sparking capability of this plug prevents misfire, keeps the engine crankcase oil clear and combustion chambers almost carbon free, and further transfers heat in an improved manner thereby virtually eliminating pre-ignition and dieseling.

While the present invention has been described in conjunction with specific embodiments thereof, it is evident that many alternatives, modifications, and variations will be apparent to those skilled in the art in light of the foregoing description. For example, the portion of the insulating element 14 extending into the cylinder may be provided in different lengths to accommodate different heat ranges, the metal used for the center electrode and disk-shaped element may be varied to allow for various heat ranges, and the gap G can also be varied, as described above. Accordingly, the present invention is intended to embrace all alternatives, modifications, and variations which fall within the spirit and scope of the appended claims.

What I claim is:

1. A spark plug having a 360° sparking zone configuration to reduce fouling and improve combustion efficiency, said spark plug, comprising:

an outer annular electrode, an insulator disposed within said outer electrode and having an axial extent, said outer electrode having an annular end face which extends axially beyond said insulator, an inner electrode secured within said insulator, and a disk-shaped element supported on an end of said inner electrode, said disk-shaped element being spaced from the end face of said outer electrode by a gap "G" and defining with said outer electrode a 360° annular sparking path having a relatively large radial dimension compared to the size of the inner electrode and in which a spark can pass between the two electrodes at any point in the region of the 360° annular sparking path between the inner electrode and the outer annular electrode so that the points of ignition in the sparking path can continually change, said disk-shaped element being relatively large in size compared to the cross sectional size of the inner electrode and having a peripheral size which is almost equal to the peripheral size of the outer electrode end face, so that the sparking path is spaced apart from and outwardly of the insulator and will not create a creepage discharge against an outer surface of the insulator.

2. The spark plug of claim 1, wherein said inner electrode comprises a rod-shaped element supported substantially centrally within said insulator.

3. The spark plug of claim 2, wherein said rod-shaped element is held within said insulator by a tight friction fit whereby said gap "G" can be maintained.

4. The spark plug of claim 3, wherein said gap "G" is adjustable.

5. The spark plug of claim 4, wherein a preferred range of adjustment for said gap "G" is between 0.020 inch and 0.080 inch.

6. The spark plug of claim 1, wherein the outer electrode includes an annular contact face comprising a hardened alloy material.

7. The spark plug of claim 6, wherein said disk-shaped element comprises an annular lip at the periphery thereof, said lip extending in the direction of said contact face.

8. The spark plug of claim 7, wherein said lip has a rectangular cross-section.

9. The spark plug of claim 7, wherein said lip has a triangular cross-section.

10. The spark plug of claim 1, wherein said disk-shaped element comprises a circular plate having substantially parallel opposing major surfaces.

11. The spark plug of claim 10, wherein sparks in said sparking path move from said outer electrode to said inner electrode.

12. The spark plug of claim 11, wherein said sparks comprise one or more simultaneously generated sparks.

13. The spark plug of claim 1 wherein a spark in the spark zone moves axially with the inner electrode between the outer and inner electrodes.

14. The spark plug of claim 1 wherein a spark in the spark zone moves in a 360° direction so that the points of ignition will continually change.

15. The spark plug of claim 1 further characterized in that said insulator is tapered inwardly from a point commencing axially beyond the end face of the outer electrode distal to the disk- shaped element in the region between and from the end face of the outer electrode to the disk-shaped element.

16. An improvement in a spark plug, having an outer annular electrode and an insulator disposed within said outer electrode and having an axial extent, and where the outer electrode has an end face which extends radially beyond said insulator, and an inner electrode secured within said insulator; wherein the improvement comprises a disk-shaped element supported on an end of said inner electrode, said disk-shaped element being spaced from the end of said outer electrode by a gap and defining with said outer electrode a 360° annular sparking path having a relatively large radial dimension compared to the size of the inner electrode in which a spark can pass between the two electrodes at any point in the region of the 360° annular sparking path between the inner electrode and the outer annular electrode so that the points of ignition in the sparking path can continually change, said disk-shaped element being relatively large in size compared to the cross sectional size of the inner electrode and having a peripheral size which is almost equal to the peripheral size of the outer electrode end face, so that the sparking path is spaced apart from and outwardly of the insulator and will not create a creepage discharge against an outer surface of the insulator.

17. The improvement in the spark plug of claim 16 wherein said sparks comprise one or more simultaneously generated sparks.

18. The improvement in the spark plug of claim 16 wherein a spark in the sparking path moves axially with the inner electrode between the outer and inner electrodes.

19. The improvement in the spark plug of claim 16 wherein a spark in the sparking path moves in a 360° direction so that the points of ignition will continually change.

20. The improvement in the spark plug of claim 16 further characterized in that said insulator is tapered inwardly from a point commencing axially beyond the end face of the outer electrode distal to the disk-shaped element in the region between and from the end face of the outer electrode to the disk-shaped element.

21. A spark plug, comprising:

an outer annular electrode, an insulator disposed within said outer electrode and having an axial extent, said outer electrode having an annular end face which extends axially beyond said insulator and is spaced from said insulator, an inner electrode secured within said insulator, and an extension element supported on the end of said inner electrode, said extension element being spaced from the end face of said outer electrode by a gap and defining with said outer electrode a 360° annular sparking path having a relatively large radial dimension compared to the size of the inner electrode and in which a spark can pass between the two electrodes at any point in the 360° annular sparking path between the inner electrode and the outer annular electrode so that the points of ignition can continually change, said extension element having a peripheral size which is almost equal to the peripheral size of the end face of the outer electrode so that the sparking path is spaced apart from and outwardly of the insulator and will not create a creepage discharge against an outer surface of the insulator, said insulator being tapered inwardly from a point commencing axially beyond the end face of the outer electrode distal to the disk-shaped element in the region between and from the end face of the outer electrode to the disk-shaped element.

22. The spark plug of claim 21 wherein a spark in the sparking path moves in a 360° direction so that the points of ignition will continually change.

* * * * *